US007726164B2

(12) United States Patent
Aho

(10) Patent No.: US 7,726,164 B2
(45) Date of Patent: Jun. 1, 2010

(54) ARRANGEMENT IN A PRESS ROLL AND A PRESS ROLL

(75) Inventor: Erkki Aho, Elimäki (FI)

(73) Assignee: Vaahto Oy, Hollola (FI)

( * ) Notice: Subject to any disclaimer, the term of this patent is extended or adjusted under 35 U.S.C. 154(b) by 703 days.

(21) Appl. No.: 11/543,963

(22) Filed: Oct. 6, 2006

(65) Prior Publication Data

US 2007/0087926 A1 Apr. 19, 2007

(30) Foreign Application Priority Data

Oct. 7, 2005 (FI) ..... 20051006

(51) Int. Cl.
*B21B 39/20* (2006.01)
*B21B 13/02* (2006.01)
*F16C 13/00* (2006.01)

(52) U.S. Cl. ..... 72/252.5; 492/2; 492/7

(58) Field of Classification Search ..... 72/252.5; 492/2, 6, 7
See application file for complete search history.

(56) References Cited

U.S. PATENT DOCUMENTS 3,672,018 A * 6/1972 Junk et al. ..... 492/7
4,249,290 A * 2/1981 Lehmann ..... 492/7
4,293,988 A * 10/1981 Biondetti ..... 492/7
4,319,522 A * 3/1982 Marchioro et al. ..... 492/7
4,334,344 A * 6/1982 Biondetti ..... 492/7
4,611,379 A * 9/1986 Heitzman ..... 29/426.5
5,138,918 A * 8/1992 Attardi et al. ..... 82/1.11
6,203,480 B1 * 3/2001 Haag et al. ..... 492/16
6,758,139 B2 * 7/2004 Knoll ..... 492/7

* cited by examiner

*Primary Examiner*—Dana Ross
*Assistant Examiner*—Mohammad Yusuf
(74) *Attorney, Agent, or Firm*—Birch, Stewart, Kolasch & Birch, LLP

(57) ABSTRACT

An arrangement in connection with supporting a press roll which press roll includes a support shaft extending through a rotating roll shell in the axial direction and being supported using at least one bearing element in at least one bearing point to a support frame, such as a bearing block, and which arrangement includes a torque support for preventing the rotation of the support shaft. At least one torque support has been arranged to at least one of the bearing points inside a bearing housing or equivalent.

17 Claims, 3 Drawing Sheets

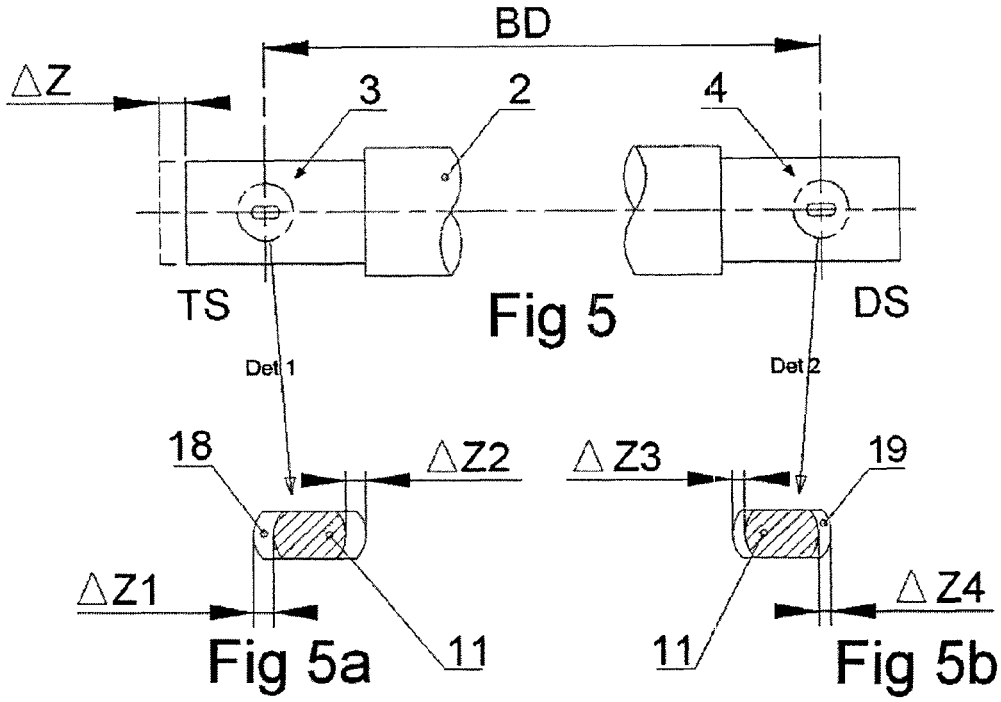
Fig 5
Fig 5a
Fig 5b
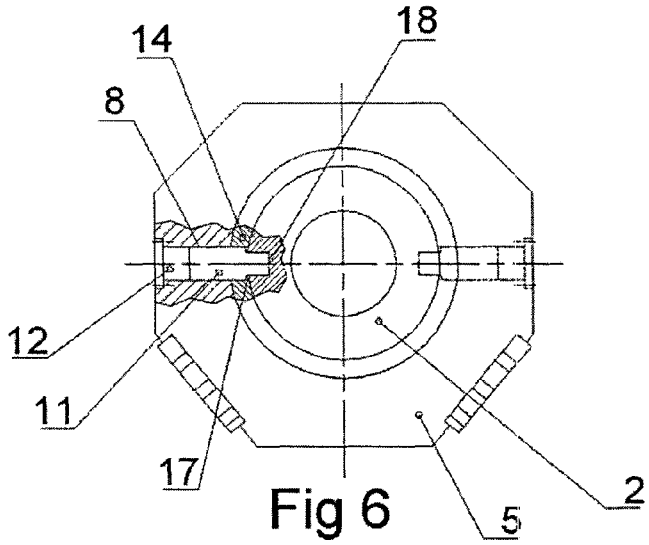
Fig 6

ARRANGEMENT IN A PRESS ROLL AND A PRESS ROLL

CROSS-REFERENCE TO RELATED APPLICATION

The present application claims priority under 35 U.S.C. §119 to Finnish Patent Application No. 2005-1006, filed Oct. 7, 2006, the entire contents of which are hereby incorporated by reference.

BACKGROUND OF THE INVENTION

1. Field of the Invention

The invention relates to a press roll.

2. Description of Background Art

Previously is known an arrangement of a deflection-compensated roll in which, between a non-rotatable centre shaft and an outer surface of the bearing housing or an outer bearing cap of the roll, there is a support element i.e. wedge support by means of which the non-rotatability of the centre shaft is provided in relation to the bearing housings. The wedge simultaneously functions as a torque support between the centre shaft and the bearing housing. The support element conveys force from the shaft to the bearing housing and further to an external support of the bearing housing. Such a solution is presented e.g. in specification FI74785B in FIG. 1, part 66. U.S. Pat. No. 4,293,988 discloses a controlled deflection roll. The roll support is prevented from carrying out any rotational movement by a pin or equivalent structure.

The structure is commonly used in paper and board machines in press and calender applications.

In known arrangements, the positioning of the torque support causes a moment of rotation to the bearing housing in relation to the centre of the housing around the vertical axis y.

SUMMARY AND OBJECTS OF THE INVENTION

The object of this invention is to achieve a totally novel solution by means of which the disadvantages of known prior art are avoided. Another object of the invention is especially to provide a support solution for the bearing housing of the press roll of the shoe press. The object of the invention is to provide a structure which can be applied also in other targets.

The invention is based on an idea according to which a torque support is arranged to a bearing line inside the bearing housing.

More precisely, According to an embodiment of the invention, an arrangement in connection with supporting a press roll which press roll comprises a support shaft extending through a rotating roll shell in the axial direction and being supported using at least one bearing element in at least one bearing point to a support frame, such as a bearing block. The arrangement comprises a torque support for preventing the rotation of the support shaft, whereby the at least one torque support is arranged to at least one of the bearing points inside a bearing housing or equivalent whereby the torque support is arranged through the bearing element between the support frame and the support shaft and at least one counter bore or equivalent is arranged to the support shaft for the end of the torque support. According to an embodiment of the invention at least one opening formed as a hole, is arranged to the bearing element.

The solution according to the invention has numerous significant advantages.

The structure is characterised by the torque support being inside the bearing in an exactly right place, i.e. within the range of forces. Then, the torque support can be arranged in an ideal way within the range of forces. By arranging the torque support through the bearing element between the support shaft and a support frame i.e. bearing housing, an advantageous and appropriate way in respect of its manufacturing technique is provided for the positioning of the torque support and the conveying of forces. By forming openings, most suitably formed holes, to the wall of the bearing housing and to the bearing element and further by positioning them according to the invention, an extremely good arrangement can be provided for supporting the press roll which also enables deflections and stretchings characteristic to the roll in use. By shaping the end of the torque support and the counter elements of the support shaft, support characteristics of the torsional moment and clearances of the support shaft can be enabled. On the other hand, by positioning the torque support to the bearing line and also horizontally to the centre line of the roll, an optimal solution is provided for the support. By shaping the torque support cylindrical at least partly so that it is able to rotate around its own axis, a support solution enabling the deflection of the support shaft is provided.

A further advantage of positioning the torque support is that the rotating torque supports in relation to the bearing housing cause no problems for the inclining of the roll in connection with the roll change or fabric change or in a similar maintenance situation. Seen from the machine direction MD, the roll can thus be positioned in an inclined position in the cross-direction CD so that one bearing housing is in position and the other is removed and the tending-side end of the roll is lifted up to a maximum angle of around 1 degree in a normal situation. This corresponds in the y direction the maximum distance of around 100 mm. necessarily, there is no need for placing intermediate pieces under the bearing housing of the shoe roll, but the bearing housings of the roll can be positioned directly on a basic frame. There is a small difference in the height of the bearing housings between the tending and driving side of the rolls, because due to the outrunning of the roll the structure requires a small release piece between the roll and the basic frame in order to be able to lower the bearing housing of the driving side to an outrunning carriage.

BRIEF DESCRIPTION OF THE DRAWINGS

Next, the invention will be described in detail by means of an example with reference to the accompanying drawing, in which FIG. 5 shows a detail of end areas of a support shaft of a press roll according to the invention, FIG. 5*a* shows a detail Det 1 of FIG. 5, FIG. 5*b* shows a detail Det 2 of FIG. 5, and FIG. 6 shows a partial section of an arrangement according to the invention seen from the axial direction of the roll.

DETAILED DESCRIPTION OF THE INVENTION

Figure 1A:
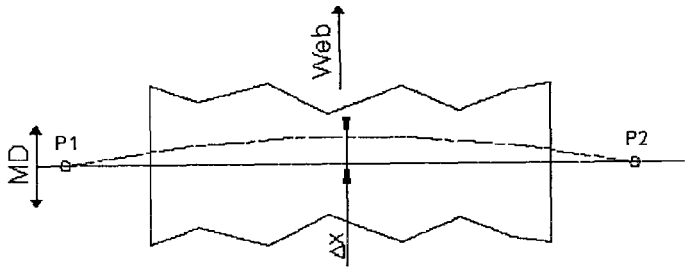
FIG. 1 shows an apparatus according to the invention, FIG. 1*a* schematically shows a detail of an apparatus according to the invention.
Figure 1:
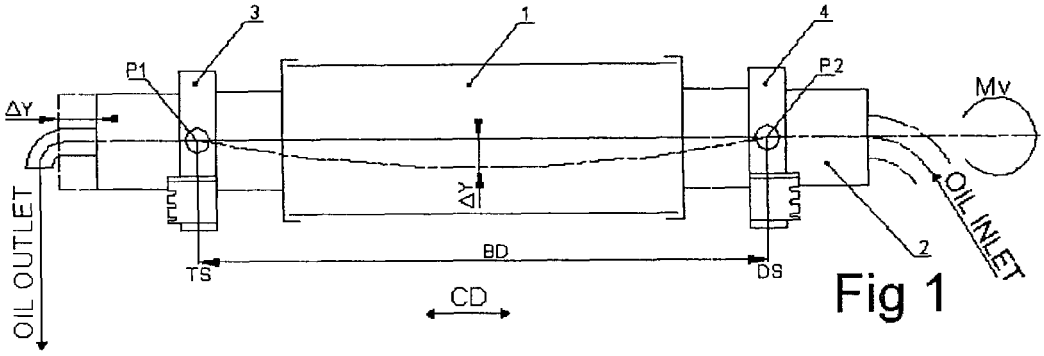

FIG. 1 shows a general situation of a roll according to the invention. Part 1 is a rotating surface fabric i.e. belt shell of a press roll, typically a shoe roll. Part 2 is a support shaft of the roll. The support shaft is generally a support beam in the bearing points of which there are shaft journals or similar. Parts 3 and 4 are bearings of the roll on the tending and driving side. The bearings 3 and 4 remain in position in the operating situation of the roll, and the centre shaft of the roll can expand because of e.g. thermal extension for a travel delta z towards the tending side TS of the machine. Usually, the bearing 4 on the driving side DS of the roll is a so-called fixed bearing, and the bearing of the tending side TS is free. Designation DS means the driving side of the roll. The roll deflects via a centre point P1, P2 of the bearings 3 and 4. The deflection reaches its maximum value delta y on the centre shaft of the roll from the effect of force prevailing in a press gap i.e. nip between the roll shell and a counter element (not shown in the figure). Simultaneously, the roll can deflect a little from the effect of the nip to the run direction of the web for a deflection delta x (FIG. 1*a*) which is perpendicular in relation to the deflection of the nip. The bearing distance of the roll is designated with measure BD. Also torsional moment Mv exerts to the support shaft 2, caused by, inter alia, forces prevailing in the press gap. A purpose of the arrangement according to the invention is, inter alia, to shift the forces of the torsional moment in question from the support shaft 2 to the support frame.

During the operation of the roll, medium, such as oil, can be led inside the roll. The medium is led from one end of the roll and, correspondingly, removed from the other or the same end of the roll, depending on the type of the roll. In the solution according to the figure, medium is supplied from the driving side DS and led away from the tending side TS.

Figure 2:
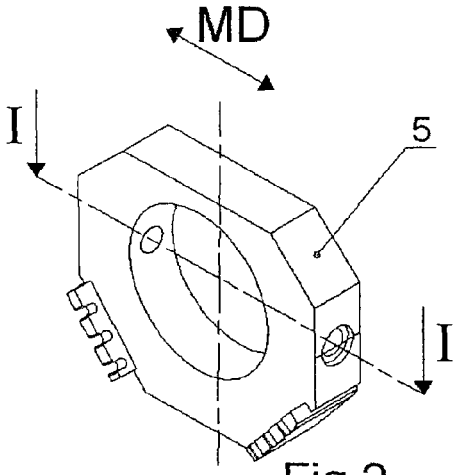
FIG. 2 shows a detail of an apparatus according to the invention.
Figure 2A:
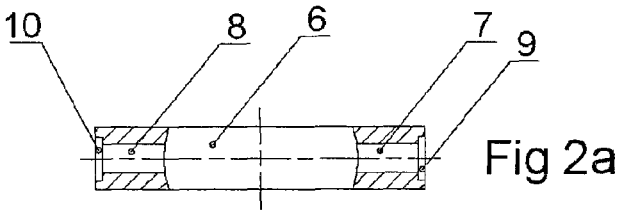
FIG. 2*a* shows a cross-section along line I-I of FIG. 2.
Figure 3A:
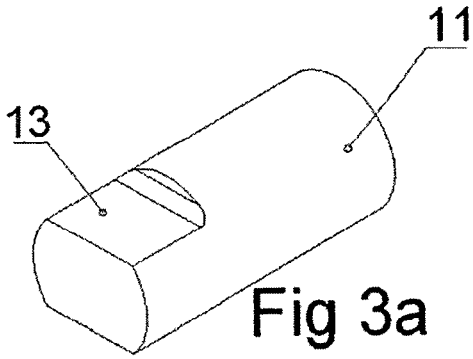
FIG. 3*a* shows a perspective view of a portion of an arrangement according to the invention.
Figure 3B:
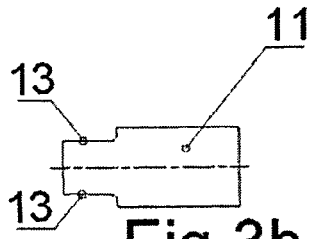
FIG. 3*b* shows a side view of a portion of an arrangement according to the invention.
Figure 3D:
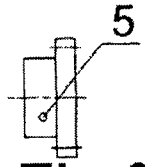
FIG. 3*d* shows a side view of a portion of an arrangement according to the invention.
Figure 3:
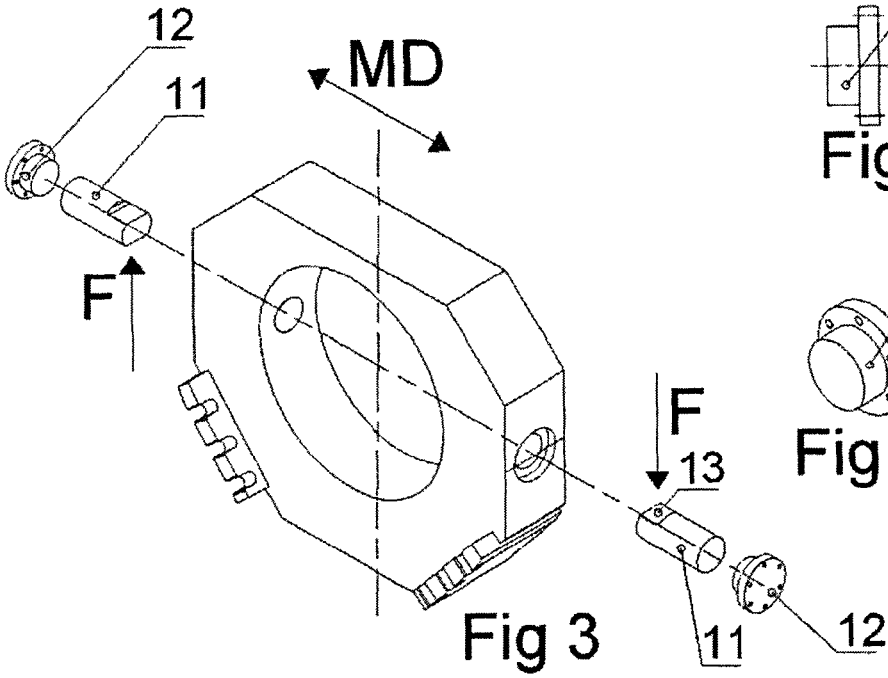
FIG. 3 shows an exploded view of a portion of an apparatus according to the invention.
Figure 3C:
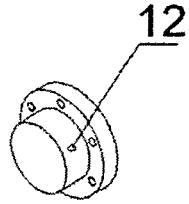
FIG. 3*c* shows a perspective view of another portion of an arrangement according to the invention.

FIG. 2 shows a bearing housing 5 in the bearing point of the bearing 3 and 4 and its cross-section A-A (FIG. 2*a*). The bearing housing is typically but not necessarily similar on both sides of the machine. Inside the bearing housing 5, there is a hole in the axial direction i.e. in the cross-direction CD of the machine on the side surface of which is formed a typically spherical machining 6. Through the side surfaces of the wall of the bearing housing 5 are formed advantageously cylindrical holes 7, 8 and for a locking element 12 counterbore machinings 9, 10. In the figure, the holes 7, 8 formed for a torque support 11 are typically substantially machine-directional MD. Furthermore, on the front surface of the bearing housing, there is an installation machining for a bearing element 14 coming inside the housing 5, not shown in the figure.

FIGS. 3, 3*a*, 3*b*, 3*c*, 3*d* show in more detail the shape of the torque support 11 and special machinings 13 for the reception of forces F. The forces caused by the torsional moment are led by means of the torque support 11 from the support shaft via the torque support to a fixed support frame 5, especially a bearing housing. The holes 7, 8 in the section corresponding the bearing housing 5 of the torque support 11 have mainly cylindrical shape, when the portion extending to the roll shaft has form-machinings which are in the embodiment of the figure substantially in the axial direction of the roll. The shape of the locking element 12 is shown in a separate figure. The torque support sets inside the bearing housing to a space 7 and 8 (FIG. 2). The locking element 12, on the other hand, sets after the torque support inside the bearing housing to a space 9 and 10. The locking element 12 keeps the torque support 11 in position inside the bearing housing in the machine direction MD.

Figure 4A:
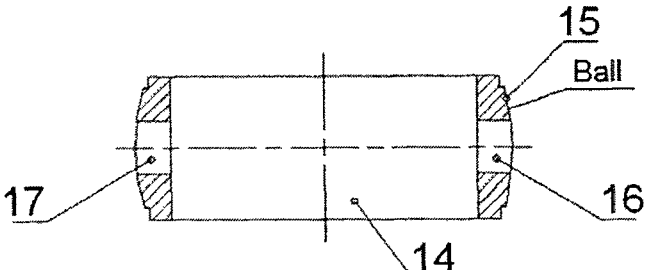
FIG. 4*a* shows a cross-section along line II-II enlarged of FIG. 4.
Figure 4:
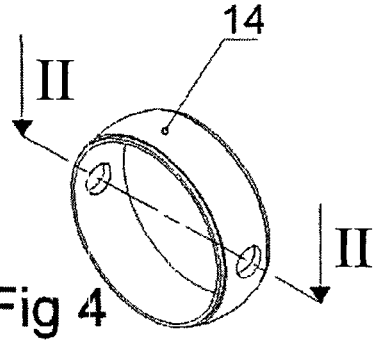
FIG. 4 shows a bearing portion of an arrangement according to the invention.

FIGS. 4 and 4*a* show a detailed shape of the bearing element 14 inside the bearing housing, typically a ball bearing. Section B-B (FIG. 4*a*) shows a sectional view of the bearing. The bearing element is an annular element through which the support shaft 2 of the roll has been arranged. A radial outer surface 15 of the bearing element is at least partially formed spherical. Cylindrical holes 16, 17 in the centre line of the bearing are arranged for the torque support 11, whereby it extends through the bearing element in the radial direction always inside the support shaft 2.

FIGS. 5, 5*a* and 5*b* show the ends of the support beam 2 in the bearing points 3 and 4. At the ends of the support shaft 2 are machined counterbore machinings 18, 19 for the torque support 11 in the bearing points 3, 4 of the roll. It is advantageous to have the counterbore machinings 18, 19 on both sides of the shaft, whereby force balance becomes the best possible, i.e. two pieces per bearing. If the surface fabric 1 is non-central in relation to the support shaft 2, one of the torque supports in the bearing points can be omitted completely, because the moment of rotation Mv of the nip load in relation to the shaft of the support beam is almost totally omitted. For manufacturing technical reasons, a small clearance delta z1 is required between the torque support 11 and the support beam 2 and, because of thermal expansion, a clearance delta z2 on the tending side TS of the machine. Correspondingly, for the driving side DS of the machine, corresponding clearances delta z3 are required on both sides of the torque support 11. The clearance delta z3 is very small compared to the clearances of the tending side TS.

FIG. 6 shows a partial section of an arrangement according to the invention seen from the axial direction of the roll. To the bearing housing 5 is arranged a bore 8. Also to the bearing ring 14 is arranged a corresponding bore 17 through. To the support shaft 2 is formed a counter element, typically a counterbore 18, for the end of the torque support 11. The bore 8 of the bearing housing, the bore 17 of the bearing ring 14 and the counterbore 18 of the support shaft are arranged in incidence so that the torque support 11 can be set in position. After this, a stopping element i.e. locking element 12 can be set into the bore 8 formed in the bearing housing. The locking element 12 can be further fastened with fastening elements, such as screws, to the bearing housing 5.

The invention thus relates to an arrangement in connection with supporting a press roll which press roll comprises a support shaft 2 extending through a rotating roll shell 1 in the axial direction and being is supported using at least one bearing element 14 in at least one bearing point 3, 4 to the support frame 5, such as a bearing block, and which arrangement comprises a torque support for preventing the rotation of the support shaft 2. At least one torque support 11 has been arranged to at least one of the bearing points 3, 4 inside the bearing housing 5 or equivalent. According to an advantageous embodiment, the torque support 11 is arranged through the bearing element 14 between the support frame 5 and the support shaft 2. At least one opening 16, 17, most suitably a formed hole, has been arranged to the bearing element 14. In the figure, two openings 16, 17 are formed to the bearing ring 14, advantageously diametrally in relation to each other. Through the wall of the bearing housing 5 is arranged at least one opening 7, 8, most suitably a formed hole, advantageously horizontally i.e. in the machine direction MD, in the centre line of the bearing housing.

To the support shaft 2 is arranged at least one counterbore 18, 19 or equivalent for the end of the torque support 11. The counterbore of the support shaft 2 is advantageously in the bearing line of the roll horizontally in the centre line of the roll. Typically, there are two counterbores and they are located on the opposite sides of the shaft diametrally. The counterbores 18, 19 are form-machinings for the end of the torque support 11. In the embodiment according to FIGS. 3, 3*a*, 3*b*, the end fitting to the counterbores of the support shaft 2 of the torque support comprises parallel surfaces 13 which are provided e.g. by machining a portion of a cylindrical bar away.

The opening 7, 8 arranged through the wall of the bearing housing 5, the opening 7, 8 of the bearing element 14 and the counterbore 18, 19 of the support shaft 2 are arranged in incidence so that the torque support 11 can be set in position.

The bearing element 14 comprises a spherical surface 15 which has at least one permeate formed hole 16, 17 horizontally in the centre line of the bearing. The support shaft 2 internally torque-supported in the bearing point 3, 4 is one- or multi-part. The support shaft 2 internally torque-supported in the bearing point 3, 4 can be central or non-central in relation to the surface fabric 1.

In the first end of the roll, the form-machining 18, 19 has such a shape that it locks the bearing housing 5 and the roll 2 mainly in relation to each other and allows only a CD-directional deflection delta y of the roll and only in a slight amount a deflection delta x occurring in the run direction MD of the web.

At the opposite end in relation to the first end of the roll, the form-machining 18, 19 has such a shape which allows the thermal expansion of the roll during operation and also length variation related to the precision of manufacture of the roll.

The torque support 11 is totally inside the bearing housing 5. There is at least one or more torque supports arranged on the periphery of the ball bearing. The torque support 11 allows a deflection of the roll in the CD direction of the machine. The torque support 11 also allows the roll to deflect a little M the run direction (MD direction) of the machine. The torque support 11 is form-machined to fit to the form-machining 18, 19 of the support shaft 2 and the form-machining 7, 8 of the bearing housing 5.

On the side surfaces of the bearing housing 5, there are form-machining counterbores 9, 10 for the locking elements 12 of the torque support. There are one or more locking elements 12, according to the number of the torque supports 11. The locking elements 12 lock the torque supports 11 inside the bearing housing 5.

The invention also relates to a press roll which press roll comprises characteristics of the arrangement described above. The arrangement according to the invention can also be used, inter alia, in connection with the press roll of the shoe press i.e. shoe roll.

It is obvious to those skilled in the art that the invention is not limited to the embodiments described above, but it can be varied within the scope of the enclosed claims. When necessary, the characteristic features possibly described in this specification together with other characteristic features can also be used separate from each other.

The invention claimed is:

1. An arrangement in connection with supporting a press roll, the press roll including a support shaft extending through a rotating roll shell in an axial direction and being supported using at least one bearing element in at least one bearing point to a support frame formed as a bearing block, and the arrangement comprising:

at least one torque support for preventing the rotation of the support shaft, wherein the at least one torque support is arranged to at least one of the bearing points inside a bearing housing or equivalent, wherein the at least one torque support is arranged through the bearing element between the support frame and the support shaft and at least one counterbore or equivalent is arranged to the support shaft for accommodating an end of the torque support, wherein the end of the at least one torque support and the at least one counterbore of the support shaft are formed in shapes in order to lead forces from the support shaft via the at least one torque support to the support frame, and wherein a shape of portion of the at least one torque support is adapted so that the at least one torque support is able to rotate around an axis thereof, thereby enabling a deflection of the support shaft.

2. An arrangement according to claim 1, wherein at least one opening formed as a hole, is arranged to the bearing element.

3. An arrangement according to claim 1, wherein through a wall of the bearing housing is arranged at least one opening formed as a hole at a centre line of the bearing housing, is the at least one opening being horizontally arranged in a machine direction MD.

4. An arrangement according to claim 1, wherein the at least one counterbore of the support is arranged in a bearing line of the press roll, the at least one counterbore being horizontally arranged in a centre line of the press roll.

5. An arrangement according to claim 1, the wherein at least one opening is arranged through a wall of the bearing housing, the at least one opening of the bearing element, and the at least one counterbore of the support shaft is arranged in incidence so that the torque support is set in position.

6. An arrangement according to claim 1, wherein the bearing element comprises a spherical surface which has at least one permeating hole formed horizontally on a centre line of the at least one bearing point.

7. An arrangement according to claim 1, wherein the support shaft is internally torque-supported by the at least one bearing point, and is one- or multi-part.

8. An arrangement according to claim 1, wherein the support shaft is internally torque-supported by the at least one bearing point, and is central or non-central in relation to a surface of the press roll.

9. An arrangement according to claim 1, wherein, in a first end of the press roll, the at least one counterbore having such a shape which is adapted to lock the bearing housing and the press roll in relation to each other, and to allow only a CD-directional deflection ($\Delta y$) of the press roll, and only in a predetermined amount a deflection ($\Delta x$) occurring in a machine direction MD of a web.

10. An arrangement according to claim 1, wherein, at an opposite end in relation to a first end of the press roll, the at least one counterbore having a shape which allows thermal expansion of the press roll during operation, and also allows a length variation related to precision of manufacture of the press roll.

11. An arrangement according to claim 1, wherein the at least one torque is totally inside the bearing housing.

12. An arrangement according to claim 1, wherein the at least one torque support allows a deflection of the press roll in a cross-direction CD direction of a machine.

13. An arrangement according to claim 1, wherein the at least one torque support allows the press roll to deflect by a predetermined amount in a machine direction MD of a web.

14. An arrangement according to claim 1, wherein the at least one torque is form-machined to fit to the at least one counterbore of the support and at least one opening of the bearing housing.

15. An arrangement according to claim 1, wherein, on side surfaces of the bearing housing, there are form-machining counterbores for locking elements of the at least one torque support.

16. An arrangement according to claim 1, wherein there are one or more locking elements, according to a number of the at least one torque support.

17. An arrangement according to claim 1, wherein locking elements lock the at least one torque support inside the bearing housing.

* * * * *